United States Patent [19]

Langen

[11] 4,308,020

[45] Dec. 29, 1981

[54] MANDREL OF WRAP-AROUND CARTON FORMING MACHINE TO PROVIDE TIGHT FIT ABOUT ENCLOSED ITEM

[75] Inventor: Marinus J. M. Langen, Rexdale, Canada

[73] Assignee: H. J. Langen & Sons Limited, Rexdale, Canada

[21] Appl. No.: 113,513

[22] Filed: Jan. 21, 1980

Related U.S. Application Data

[63] Continuation-in-part of Ser. No. 900,418, Apr. 27, 1978, abandoned.

[51] Int. Cl.[3] ..... B31B 1/28

[52] U.S. Cl. ..... 493/175; 53/566; 53/575; 493/163; 493/468

[58] Field of Search ..... 53/207, 252, 566, 575, 53/255, 258, 261, 262; 493/175, 163, 468

[56] References Cited

U.S. PATENT DOCUMENTS

| | | | |
|---|---|---|---|
| 641,188 | 1/1900 | de Castillo | 53/575 X |
| 2,656,082 | 10/1953 | Brown | 53/255 |
| 3,001,345 | 9/1961 | Zeller | 53/258 X |
| 3,479,930 | 11/1969 | Peppler | 53/575 X |
| 4,015,403 | 4/1977 | Langen | 53/575 X |

FOREIGN PATENT DOCUMENTS

| | | | |
|---|---|---|---|
| 2302914 | 6/1976 | France | 53/255 |
| 1452072 | 10/1976 | United Kingdom | 53/262 |

*Primary Examiner*—Gus T. Hampilos

*Attorney, Agent, or Firm*—Fetherstonhaugh & Co.

[57] ABSTRACT

The improved wrap-around carton forming and loading machine of the present invention is capable of forming cartons around the articles supported by a mandrel such that upon removal of the mandrel, the carton will engage and support the article, the improved mandrel resiliently deflects selected side walls of the carton outwardly when formed thereabout to the required sleeve configuration so that upon withdrawal of the mandrel the side walls will revert to their predetermined configuration and engage the article. In addition, the mandrel has a free end about which the end flaps of the carton may be folded to a closed position corresponding to the ultimate erect configuration of the carton.

3 Claims, 4 Drawing Figures

Figure 1:
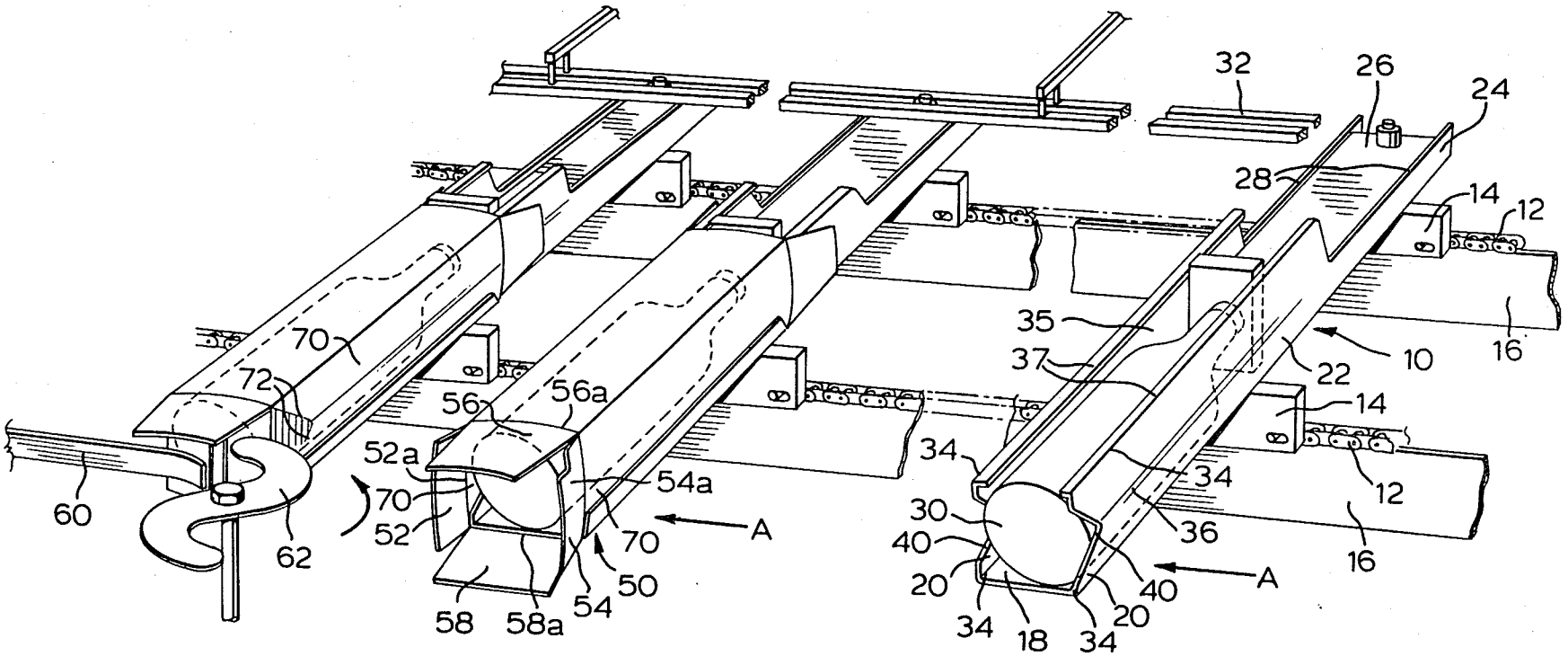

MANDREL OF WRAP-AROUND CARTON FORMING MACHINE TO PROVIDE TIGHT FIT ABOUT ENCLOSED ITEM

RELATED APPLICATIONS

This application is a continuation-in-part of application Ser. No. 900,418 filed Apr. 27, 1978, now abandoned.

FIELD OF INVENTION

This invention relates to wrap-around carton forming and loading machines. In particular, this invention relates to improvements in the wrap-around carton forming and loading machine which enable a carton to be formed around a mandrel which houses the article to be stored in the package while providing that, upon removal of the mandrel, the side walls of the carton will be located in intimate engagement with the article following withdrawal of the mandrel.

In a packaging of many items to form shipper packages, it is important to ensure that the article is engaged by the side walls of the package so that during shipping and handling the article is not free to move relative to the package and thereby create an unstable load.

Wrap-around carton forming machines have enjoyed considerable success in the packaging of articles which are not of a fixed configuration and in which movement of the article in relation to the carton is not likely to occur or if it does occur, is not of any importance.

In the packaging of individual bottles, such as liquor bottles, in a carton, it is important to ensure that the bottle is a close fit in the carton for the reasons discussed above. In the conventional wrap-around carton forming operation, the mandrel is disposed between the article and the carton during the forming of the carton to a sleeve configuration. Thus, when the mandrel is withdrawn a clearance space is provided between the article and the walls of the carton. This clearance space is undesirable in a shipper package such as that containing a bottle or the like as it would permit the bottle to move relative to the container and this movement could result in damage to the bottle during shipping and handling of a large load of bottles.

It is well known that the perimeter of a square is greater than the circumference of the largest circle which it will enclose by the factor $4/\pi=1.27$. I have recognized that this relationship can be used to advantage to permit me to interpose a mandrel between a cylindrical object and the walls of a carton which have a perimeter length equal to that of the square which would embrace the cylindrical item. This is achieved by forming the mandrel so that it temporarily retains the walls of the container in a configuration more closely approaching that of a circle having a circumference equal to the perimeter of the required configuration.

Having designed an apparatus which will permit selected side walls of the carton to be resiliently deflected outwardly to permit the forming of a sleeve about a mandrel which, upon withdrawal of the mandrel, will provide a carton with side wall panels engaging the article, difficulty was experienced in attempting to close one end of the carton, while mounted on the mandrel, to the required configuration of the erected carton. If the end flaps were merely folded over when the carton was in the sleeve configuration resiliently deflected away from its ultimate configuration, the resulting end wall closure would correspond to the preliminary sleeve configuration. Thus, while it is necessary to deform the main body of the sleeve from its ultimate configuration when it is on the mandrel, it is also necessary to locate the end flaps in precisely the same position which they must assume when the carton is in the erect configuration.

The difficulties associated with the correct closure of the end flaps have been overcome by ensuring that the means for resiliently deflecting the side panels of the carton terminate inwardly from the end of the mandrel about which the end flaps are folded to effect closure whereby the end flaps may be folded to and sealed in an end closing position corresponding to the ultimate erect configuration.

SUMMARY OF INVENTION

According to one aspect of the present invention, there is provided in a wrap-around carton forming and loading machine for forming carton blanks which consist of a plurality of side panels hingedly connected to one another along weakened fold lines, and end closure flaps for closing opposite ends of the carton, the improvement of; a mandrel having internal support means for supporting a cylindrical shaped item inwardly thereof and external support means about which a container may be formed which will assume a square configuration in intimate contact with the cylindrical item when the mandrel is withdrawn, the internal support means being in the form of a plurality of innermost portions of said mandrel which are retained at circumferentially spaced intervals about the circumference of a first perimeter having a diameter substantially equal to that of the cylindrical item so as to receive the cylindrical item in a close fitting relationship, said external support means being in the form of a plurality of outermost portions of said mandrel which are retained at circumferentially spaced intervals about a second perimeter spaced outwardly from said first perimter, said second perimeter having a length which is greater than the first perimeter and not exceeding 1.27 times that of the first perimeter whereby the mandrel is proportioned to fit between the outer circumference of a cylindrical item having an external diameter X and a container having a perimeter measuring 4X.

According to a further aspect of the present invention, there is provided a wrap-around carton forming machine as described above wherein the mandrel has a free end about which the end flaps of a carton located thereon are folded to close one end thereof, said deflector means terminating inwardly from said free ends whereby the end flaps may be folded to and sealed in an end closing position corresponding to the ultimate erect configuration of the carton.

PREFERRED EMBODIMENT

Figure 2:
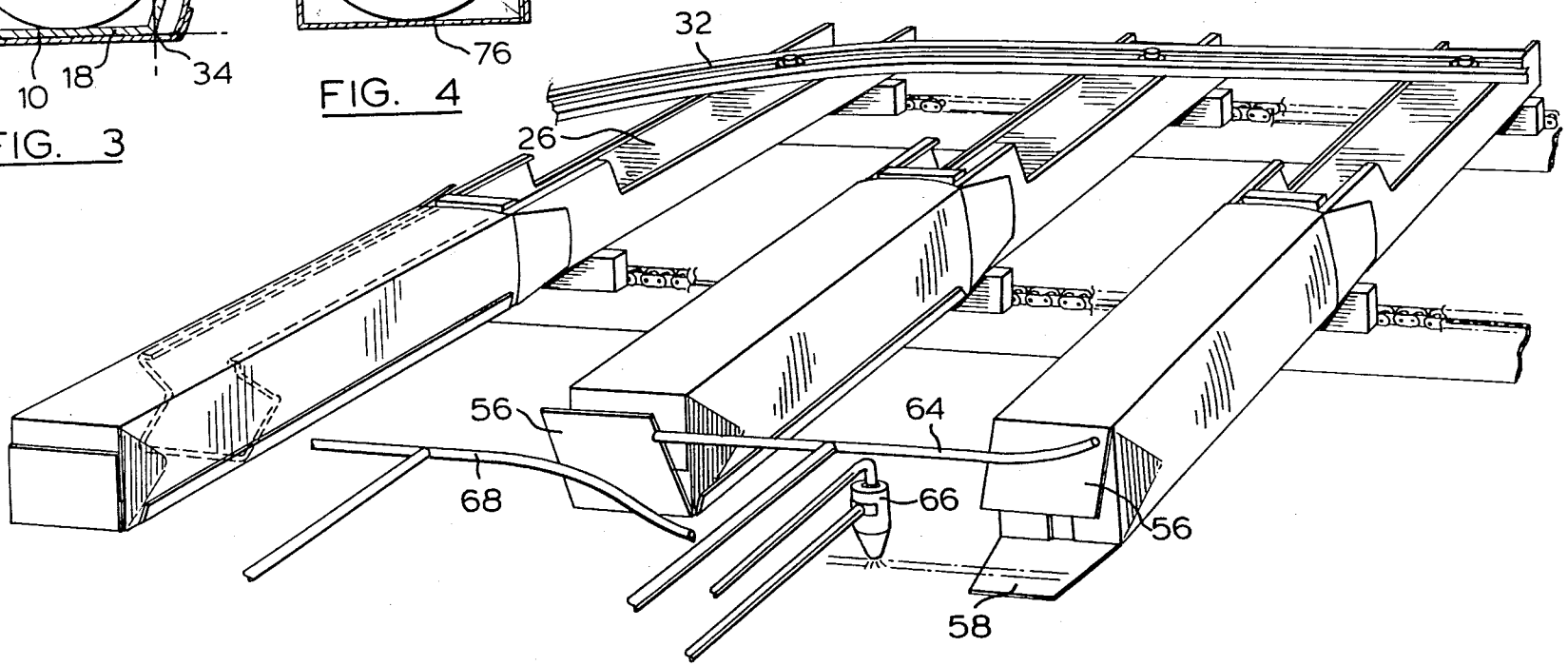
Figure 4:
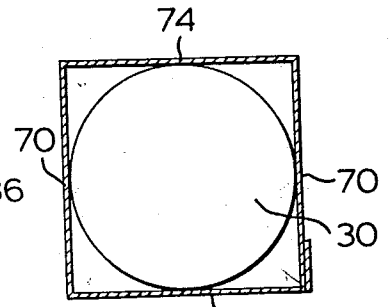
Figure 3:
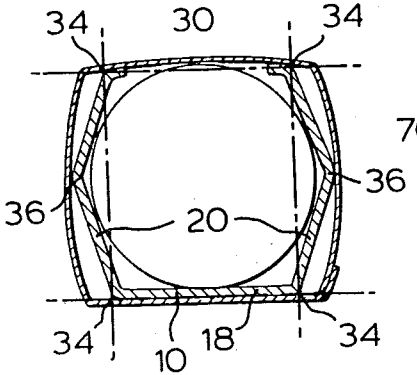

The invention will be more clearly understood after reference to the following detailed specification read in conjunction with the drawings wherein, FIG. 1 is a pictorial view of a plurality of mandrels mounted on a conveyor of a wrap-around carton forming machine, FIG. 2 is a view similar to FIG. 1 showing a final stage in the closing of the end flaps of a carton and the ejection of a loaded carton, FIG. 3 is a sectional view through a carton blank and mandrel showing the carton blank resiliently deformed about the mandrel, FIG. 4 is a cross-sectional view of a carton arranged in the ultimate erect configuration with the side panels thereof engaging the article which is located therein.

The improvements of the present invention are in the construction of the mandrel bucket generally identified by the reference numeral 10. Mandrel buckets of the present invention may be mounted on a carton loading machine of the type described in my prior U.S. Pat. No. 4,015,403, dated Apr. 5, 1977. Consequently, the structure of the carton forming machine as a whole will not be described in the present application in detail.

The mandrel buckets 10 are detachably mounted on moving conveyor chains 12 by mounting brackets 14; the moving conveyor chains 12 being supported by guide rails 16.

Each mandrel bucket 10 consists of a sheet metal body folded upon itself to form a bottom wall 18 and a pair of oppositely disposed side walls 20. The inner faces of the bottom wall 18 and side walls 20 are preferably coated with a material such as TEFLON (Trade Mark) having a low coefficient to friction whereby articles such as bottles 30 may be end loaded through an open end of the bucket so as to slide along the bucket without damaging labels or other matter appearing on the surface of the bottle or container. Each mandrel bucket 10 has a forward portion 22 and a rear portion 24. The side walls 20 are notched at 28 in the rear portion 24 so as to fit below guide rails 32 used to guide the pusher unit 26 between its retracted and extended positions. The side walls 20 and the front portion 22 are proportioned according to the proportion of the carton which is to be formed. The mandrel 10 has forming edges 34 extending longitudinally thereof about which a carton blank is folded in use. Side walls 20 are also folded about a longitudinally extending ridge 36.

The forming edges 34 are located at the corners of a rectangle which is smaller than the square configuration of the carton arranged in the ultimate erect configuration. The ridges 36 project outwardly from the plane extending between adjacent folding corners 34 a distance sufficient to project outwardly beyond the square configuration of the interior of the carton arranged in the ultimate erect configuration. Thus, while the ridges 36 serve to deflect oppositely disposed side wall panels of the carton blank outwardly from their final erect configuration, the folding edges 34 are spaced inwardly to permit inward deflection of the fold lines of the panel so that the wall panels of the carton will assume a rounded configuration.

The outer end of each side wall 20 of the mandrel 10 is formed with a V-shaped notch 40 which extends inwardly to the ridge 36. The notch 40 serves to permit one end of the sleeve to be closed to the required configuration before withdrawal of the mandrel. The notch 40 has the effect of removing the effectiveness of the ridge 36 adjacent the free end of the mandrel so that the mandrel does not forceably hold the side wall panels of the carton in the outwardly deflected position at the free end.

In use, articles such as bottles 30 are loaded into the mandrel buckets 10 through the free end thereof. The mandrels are driven through a carton wrapping station and a carton blank is wrapped around the mandrel in a conventional manner. The mandrel submerged from the carton wrapping station with the carton blank wrapped thereabout as shown at 50 in FIG. 2 with the end flaps 52, 54, 56 and 58 in the open position. The end flaps 52 and 54 are folded to the closed position by plow-bar 60 and kickerwheel 62 respectively. As shown in FIG. 2 of the drawings, the top flap 56 is folded downwardly by plow-bar 64. An adhesive coating is applied to the flap 58 by adhesive applicator 66 and the panel 58 is folded over the panel 56 by plow-bar 68. The carton and its contents are then discharged from the mandrel by the pusher mechanism 26 as it is guided along the guide track 32.

It will be noted that by reason of the provision of the notches 40, the hinge lines 52*a*, 54*a*, 56*a* and 58*a* may assume a true square configuration before their associated end flaps are sealed in the closed position. To achieve this regular square configuration, the side wall panels 70 will bend inwardly to form crease lines 72 extending along the edges of the notches 40. The bottom wall panel of the carton will be supported in a rectangular configuration by reason of the generally flat configuration of the bottom wall 18 and the top wall of the carton will be free to move inwardly to the square configuration by reason of the longitudinal passage 35 formed between the lips 37 extending inwardly from the upper ends of the side walls 20.

While FIG. 3 of the drawings is not to scale, it shows diagrammatically the position which the carton will assume when wrapped around the mandrel 10 and its associated article 30. FIG. 4 shows the position which the carton will assume when the mandrel is removed. We noted that in FIG. 4 the side wall 70, top wall 74 and bottom wall 76 each engage the article 30.

As indicated above, the mandrel 10 is proportioned according to the proportions of the carton which is to be formed. The proportions of the carton are determined by the diameter of the article 30 so that the side walls of the container contact the article when in the required squared configuration. Thus, if the diameter of the article 30 is D, its circumference is $\pi D$. The length of the perimeter of the square within which a circle of this diameter may be enclosed is 4D. Thus, the perimeter of the square is greater than the circumference of the circle by a factor $4/\pi = 1.27$. It is, therefore, possible to proportion the mandrel so that it may be interposed between the cylindrical article and a carton blank proportioned to form a square enclosure about the cylindrical article by merely ensuring that the perimeter of the mandrel, with the article located therein, is less than the perimeter of the enclosing square shaped container.

Thus it will be seen that the proportions of the carton are determined by the proportions of the article and the proportions of the mandrel are determined by the proportions of the gap which may be achieved between the circular article and the carton by deflecting the carton walls toward the circular configuration. By reason of the difficulties described above in attempting to close the end of a squared container, it will be apparent that it is desirable to make every effort to minimize the deflection of the walls away from their final square configuration.

From the foregoing, it will be apparent that the mandrel of the present invention permits wrap-around forming machines to be used for packaging articles such as bottles in cartons with the side walls of the carton arranged in intimate contact with its contents after withdrawal of the forming mandrel.

What I claim as my invention is:

1. In a wrap-around carton forming and loading machine for forming carton blanks which consist of a plurality of side panels hingedly connected to one another along weakened fold lines, and end closure flaps for closing opposite ends of the carton, the improvement of; a mandrel having internal support means for supporting a cylindrical shaped item inwardly thereof and external support means about which a container may be formed which will assume a square configuration in intimate contact with the cylindrical item when the mandrel is withdrawn, the internal support means being in the form of a plurality of innermost portions of said mandrel which are fixed with respect to one another and located at circumferentially spaced fixed points about the circumference of a first circular perimeter having a diameter substantially equal to that of the cylindrical item so as to receive the cylindrical item in a close fitting relationship, said external support means of said mandrel defining a plurality of outermost points, the locus of which defines a second perimeter the length of which is greater than the first circular perimeter by an amount not exceeding 1.27 times that of the first circular perimeter said outermost points of said second perimeter including four corner points arranged in a generally square configuration and at least two side points arranged laterally outwardly from a line drawn between each of two adjacent corner points, whereby the second perimeter defines a figure having at least six angles, said mandrel being proportioned to fit between said first circular perimeter having a diameter X and said second perimeter measuring 4X.

2. In a wrap-around carton forming and loading machine for forming carton blanks which consist of a plurality of side panels hingedly connected to one another along weakened fold lines, and end closure flaps for closing opposite ends of the carton, the improvement of; a mandrel having a bottom wall and a pair of oppositely disposed side walls connected to the bottom wall defining opposite bottom corners of the mandrel, the side walls extending upwardly therefrom, the side walls each having an upper end extending longitudinally thereof which define an upper corner of the mandrel, the side walls extending outwardly between adjacent upper and lower corners of the mandrel to form support ridges extending longitudinally thereof substantially centrally of the height of the side walls, passage means defined by the upper ends of the side walls and extending longitudinally of the mandrel, innermost portions of the side walls and bottom wall forming internal support means for supporting a cylindrical shaped item inwardly of the mandrel and said bottom corners, upper corners and support ridges forming external support means about which a container may be formed which will assume a square configuration in intimate contact with the cylindrical item when the mandrel is withdrawn from between the cylindrical item and the container, said innermost portions of said bottom and side walls defining a plurality of points, the locus of which defines a first circular perimeter having a diameter substantially equal to that of said cylindrical item so as to receive and support a cylindrical item in a close fitting relationship, the external support means defining a plurality of points, the locus of which defines a second perimeter the length of which is greater than that of the first circular perimeter by an amount not exceeding 1.27 times that of the first circular perimeter, said mandrel being proportioned to fit between said first circular perimeter having a diameter X and said second perimeter defining a square having a perimeter measuring 4X.

3. A wrap-around carton forming machine as claimed in claim 2 wherein said mandrel has a free end at one end thereof about which the end flaps of a container are folded to close one end of the carton, said support ridges of said side walls terminating a substantial distance inwardly from the free end of the mandrel whereby at the free end the upper and lower corners of the mandrel define extremities of the external support which is substantially square whereby the end flaps of the carton may be folded to and sealed in a square end closing configuration.

* * * * *